US006460515B2

(12) United States Patent
Askew

(10) Patent No.: US 6,460,515 B2
(45) Date of Patent: Oct. 8, 2002

(54) FUEL SYSTEM

(75) Inventor: James Martin Anderton Askew, Glos (GB)

(73) Assignee: Lucas Industries Limited (GB)

( * ) Notice: Subject to any disclaimer, the term of this patent is extended or adjusted under 35 U.S.C. 154(b) by 0 days.

(21) Appl. No.: 09/422,579

(22) Filed: Oct. 21, 1999

(65) Prior Publication Data

US 2002/0007824 A1 Jan. 24, 2002

(30) Foreign Application Priority Data

Oct. 22, 1998 (GB) ..... 9823025

(51) Int. Cl.[7] ..... F02M 37/04
(52) U.S. Cl. ..... 123/506; 123/198 DB
(58) Field of Search ..... 123/506, 495, 123/198 DB, 514; 137/115.07, 115.23; 239/88–95

(56) References Cited

U.S. PATENT DOCUMENTS

| | | | | | |
|---|---|---|---|---|---|
| 3,726,301 | A | * | 4/1973 | Schmidt | 137/115.23 |
| 4,095,611 | A | * | 6/1978 | Hetz | 137/115.23 |
| 4,361,166 | A | * | 11/1982 | Honaga | 137/115.07 |
| 4,630,588 | A | * | 12/1986 | Sagawa | 123/506 |
| 4,640,255 | A | * | 2/1987 | Hafele | 123/495 |
| 4,711,216 | A | * | 12/1987 | Takeuchi | 123/506 |
| 5,020,498 | A | * | 6/1991 | Linder | 123/506 |
| 5,125,807 | A | * | 6/1992 | Kohler | 123/506 |
| 5,394,851 | A | * | 3/1995 | Cryer | 123/506 |
| 5,979,415 | A | * | 11/1999 | Sparks | 123/506 |
| 6,029,632 | A | * | 2/2000 | Augustin | 123/506 |

FOREIGN PATENT DOCUMENTS

| | | |
|---|---|---|
| DE | 196 21 583 | 1/1997 |
| DE | 197 15 234 | 6/1998 |
| JP | 60 067759 | 8/1985 |

* cited by examiner

*Primary Examiner*—Carl S. Miller

(57) ABSTRACT

A fuel system, for use in supplying pressurised fuel to a combustion space, comprises a fuel source of pressurised fuel and a fluid pressure actuable valve controlling communication between the fuel source and an injection nozzle. The fuel system further comprises a second source of control fluid under pressure and a control valve controlling the application of control fluid under pressure to the fluid pressure actuable valve to control operation of the fluid pressure actuable valve. The invention also relates to a fuel injector for use in such a fuel system, the fuel injector comprising the injection nozzle, the fluid pressure actuable valve and the control valve.

15 Claims, 2 Drawing Sheets

FUEL SYSTEM

This invention relates to a fuel system for use in supplying fuel under high pressure to a combustion space of an internal combustion engine. In particular, the invention relates to a fuel system of the type in which the timing of fuel delivery is controlled using a control fluid independent of the fuel to be delivered.

Such a fuel system is suitable for use with engines used in certain marine applications in which the fuel is of relatively high viscosity at low temperatures and so is not suitable for lubricating the movement of valves, is unsuitable for use in controlling the operation of a fluid pressure actuable valve and may impede the operation of electromagnetic actuators used in controlling the operation of valves.

According to the present invention there is provided a fuel system of the type defined hereinbefore comprising a source of fuel arranged to be charged with fuel to a high pressure, a fluid pressure actuable valve controlling communication between the fuel source and an injection nozzle, a source of control fluid under pressure, and a control valve controlling the application of control fluid under pressure to the fluid pressure actuable valve to control operation of the fluid pressure actuable valve.

The control valve is conveniently electromagnetic controlled and is conveniently located between the source of control fluid under pressure and the fluid pressure actuable valve. Alternatively, the control valve may be located between the fluid pressure actuable valve and a low pressure drain. In either case, the control valve is conveniently arranged to control the fluid pressure within a control chamber defined, in part, by a surface associated with the fluid pressure actuable valve.

The fluid pressure actuable valve is conveniently further arranged to control communication between at least one passage and/or chamber of the injection nozzle and a low pressure fuel reservoir.

The injection nozzle, the fluid pressure actuable valve and the control valve conveniently form part of a fuel injector. The invention also relates to such a fuel injector.

The invention will further be described, by way of example, with reference to the accompanying drawings, in which.

Figure 1:
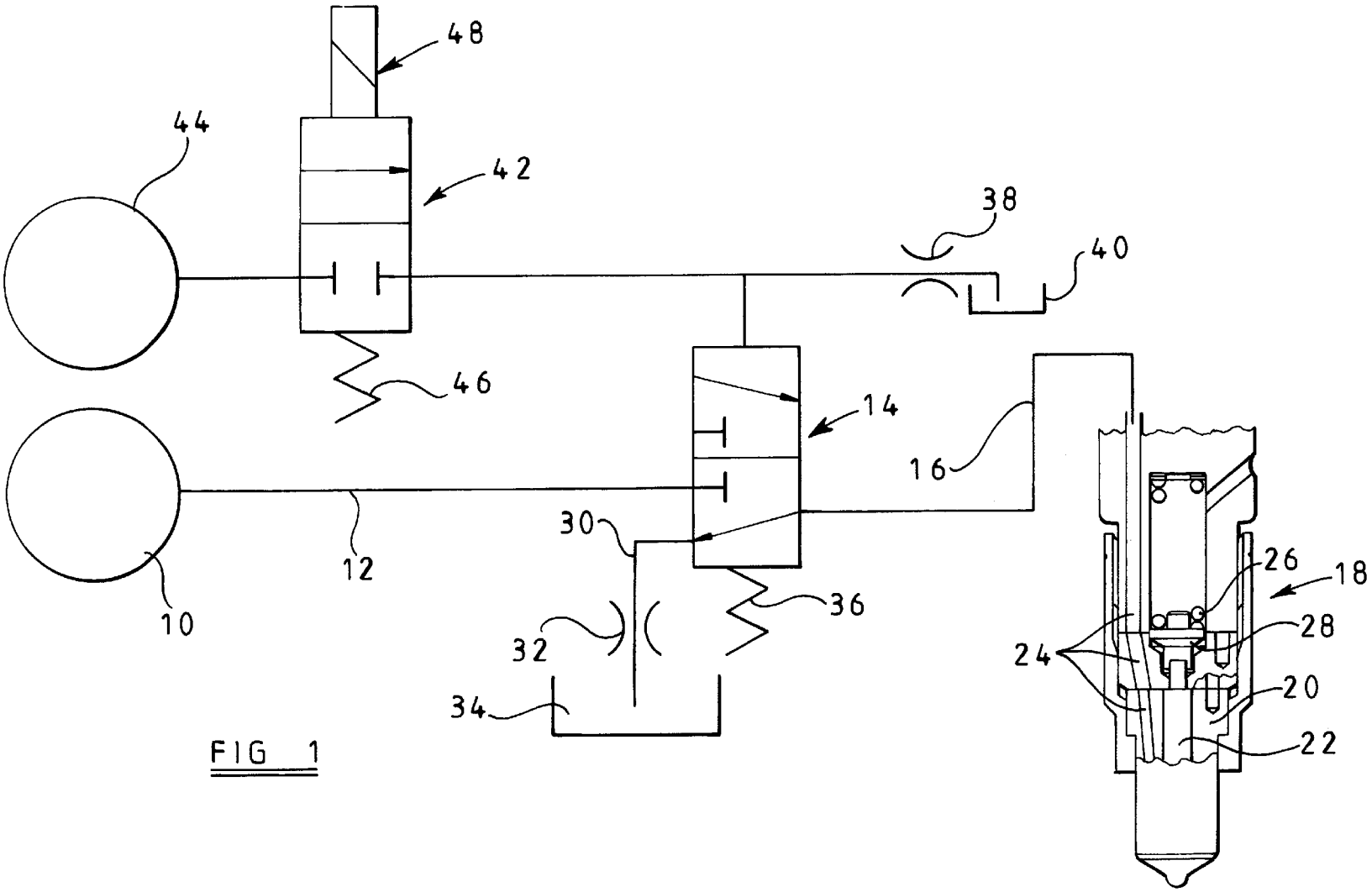
FIG. 1 is a diagrammatic view of a fuel system in accordance with an embodiment of the invention.

The fuel system illustrated in the accompanying drawings comprises a common rail 10 which is charged with fuel to an appropriate high pressure by a suitable fuel pump (not shown). The common rail 10 communicates through a passage 12 with a fluid pressure actuable valve 14, the valve 14 communicating through a passage 16 with the injection nozzle 18 of a fuel injector. The injection nozzle 18 comprises a nozzle body 20 having a bore formed therein within which a valve needle 22 is slidable. The bore of the nozzle body 20 and the needle 22 together define a delivery chamber which communicates through driffings 24 provided in the injection nozzle 18 with the passage 16. The needle 22 includes thrust surfaces exposed to the fuel pressure within the delivery chamber and orientated such that the application of fuel under high pressure to the delivery chamber applies a force to the needle 22 urging the needle 22 away from an associated seating. The injection nozzle 18 further includes a spring 26 which engages a spring abutment member 28 carried by the needle 22 and arranged to bias the needle 22 into engagement with the seating to prevent fuel from flowing from the delivery chamber to one or more outlet openings (not shown) located downstream of the seating.

Figure 2:
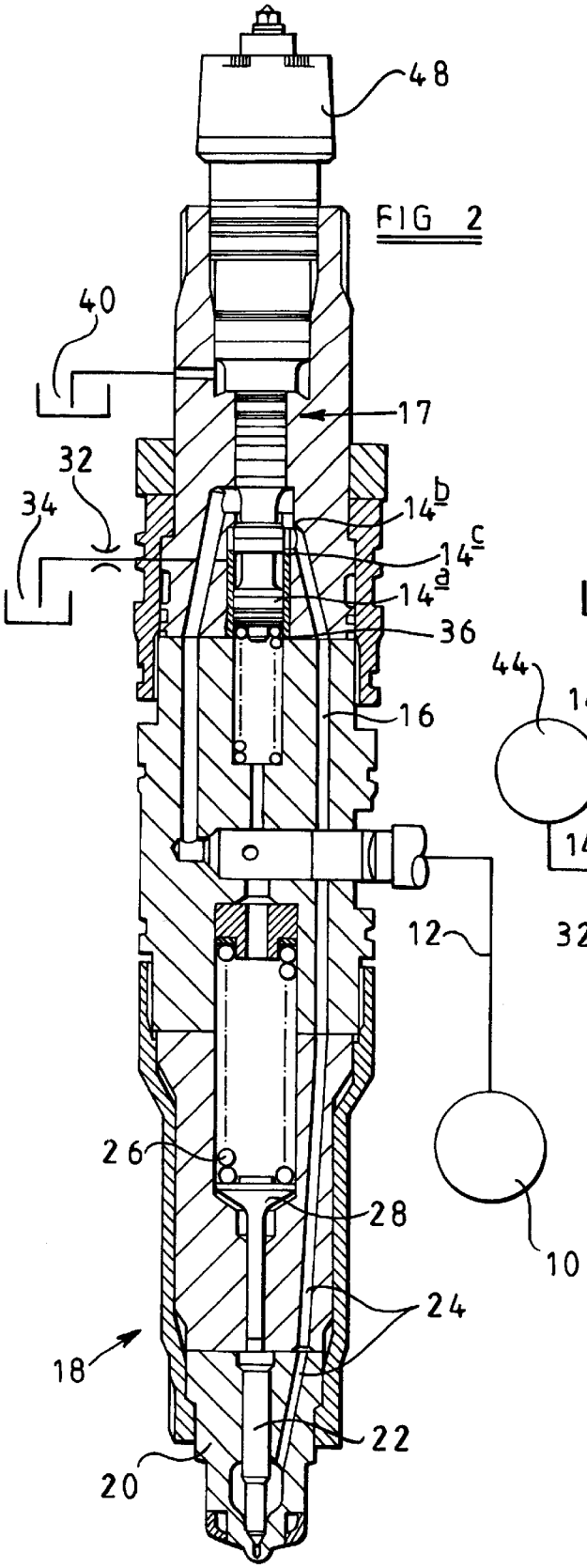
FIG. 2 is a sectional view illustrating an injector incorporating part of the fuel system of FIG. 1.
Figure 3:
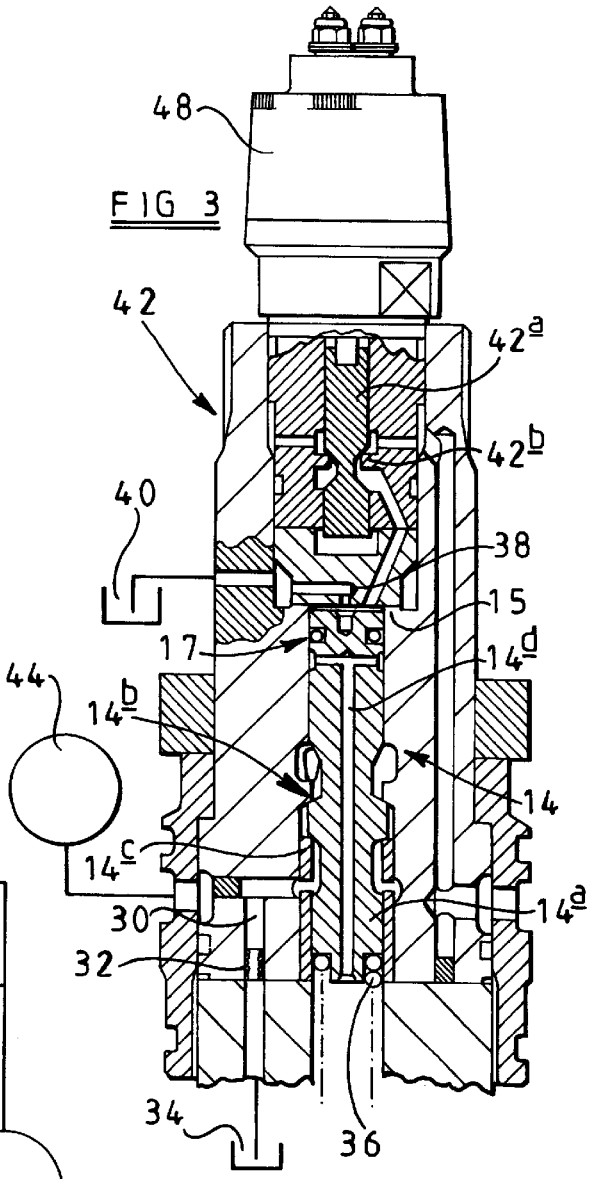
FIG. 3 is a view to an enlarged scale illustrating another section of part of the injector of FIG. 2.

The fluid pressure actuable valve 14 is illustrated somewhat diagrammatically in FIG. 1 but is shown in greater detail in FIGS. 2 and 3 and comprises a valve member 14*a* slidable within a bore and engageable with a seating 14*b* to control communication between the passage 12 and the passage 16, and with a seating 14*c* also to control communication between the passage 16 and a drain passage 30 which communicates through an appropriate flow restrictor 32 with a low pressure fuel reservoir 34. The fluid pressure actuable valve is biased by a spring 36 towards a position in which communication between the passage 12 and the passage 16 is broken, and in which communication is permitted between the passage 16 and the drain passage 30.

The valve member 14*a* of the fluid pressure actuable valve 14 includes a surface which defines, in part, a control chamber 15, the said surface of the fluid pressure actuable valve being orientated such that the application of fluid under relatively high pressure to the control chamber 15 applies a force to the valve member of the fluid pressure actuable valve which urges the valve member against the action of the spring 36 towards a position in which communication is permitted between the passage 12 and the passage 16, and in which the communication between the passage 16 and the drain passage 30 is broken.

The control chamber 15 communicates through a restriction 38 with a low pressure control fluid reservoir 40, the control chamber also communicating with a port of a control valve 42 arranged to control the supply of control fluid under high pressure from a source 44 of control fluid under high pressure to the control chamber 15. The control valve 42 is illustrated somewhat diagrammatically in FIG. 1, but is illustrated in greater detail in FIG. 3, and takes the form of a valve member 42*a* which is biased by means of a spring 46 (not shown in FIG. 3) towards a position in which the valve member engages a seating 42*b* to prevent communication between the source 44 and the control chamber 15, the valve member being moveable under the influence of an electromagnetic actuator 48, against the action of the spring 46, to a position in which communication between the source 44 and the control chamber is permitted.

In use, starting from the position illustrated, the control valve 42 occupies a position in which control fluid under high pressure is not supplied to the control chamber. The control chamber is therefore at relatively low pressure, the control chamber communicating through the restriction 38 with the low pressure reservoir 40. As a result, the valve member of the fluid pressure actuable valve 14 occupies its position in which communication is permitted between the passage 16 and the drain passage 30, communication between the passage 12 and the passage 16 not occurring. In this position, the delivery chamber of the injection nozzle is at relatively low pressure, and in these circumstances, the needle 22 engages its seating due to the action of the spring 26, thus injection of fuel is not taking place.

In order to commence injection, the actuator 48 is energized to move the valve member of the control valve 42 to a position in which control fluid under high pressure from the source 44 is supplied to the control chamber. A small quantity of control fluid will escape through the restriction 38 to the low pressure reservoir 40, but the restriction 38 is dimensioned to restrict this quantity of fluid. The action of the control fluid under high pressure applies a force to the valve member of the fluid pressure actuable valve 14, moving the valve member against the action of the spring 36 to its alternative position. In this position, the communication between the passage 16 and the drain passage 30 is broken, and instead fuel under high pressure is able to flow from the common rail 10 through the passage 12 to the passage 16 and from there to the delivery chamber. The fuel pressure within the delivery chamber rises, and a point will be reached beyond which the fuel pressure within the delivery chamber applies a sufficiently large force to the needle 22 to lift the needle 22 away from its seating against the action of the spring 26. Such movement of the needle 22 permits fuel to flow to the outlet openings of the injection nozzle, thus delivery of fuel through the outlet openings takes place.

In order to terminate injection, the actuator 48 is de-energized, the spring 46 returning the control valve 42 to the position illustrated. Once this position has been reached, control fluid is no longer supplied to the control chamber, and the fluid pressure within the control chamber rapidly falls due to the communication between the control chamber and the low pressure reservoir 40. A point will be reached beyond which the fluid pressure within the control chamber is insufficient to maintain the fluid pressure actuable valve in its alternative position, the fluid pressure actuable valve returning to the position illustrated under the action of the spring 36. Once this position has been reached, it will be appreciated that no further fuel is supplied to the injection nozzle, and fuel is able to escape from the delivery chamber to the low pressure fuel reservoir 34. The continued delivery of fuel through the outlet openings in conjunction with the escape of fluid from the delivery chamber to the low pressure fuel reservoir 34 allows the fuel pressure within the delivery chamber to fall, and a point will be reached beyond which the needle 22 is able to return into engagement with its seating under the action of the spring 26, thus terminating injection.

It will be appreciated that in the fuel system described hereinbefore, no fuel is present around the electromagnetic actuator, and as a result, the fuel system may be used with a fuel of the type used in certain marine applications in which the fuel is of relatively high viscosity at low temperatures. Further, it will be appreciated that mining of the control fluid with the fuel is restricted such that cross contamination does not occur to an unacceptable level. The fluid used as the control fluid may be engine lubrication oil, but any alternative suitable pressurized fluid may be used. Where the engine lubrication oil is used, the source 44 may be defined, at least in part, by the oil distribution pipework of the engine. As shown in FIGS. 2 and 3, the avoidance of mixing of fuel with the control fluid can be improved by locating an annular seal 17 on the valve member 14*a* to resist cross contamination. The valve member 14*a* may additionally be provided with a network of drillings 14*d* whereby any fuel flowing alongside the valve member towards the control chamber may be returned to an appropriate low pressure reservoir.

Although in the illustrated embodiment, the control valve is located between the source of fluid under high pressure and the control chamber, it will be appreciated that the positions of the control valve 42 and the restriction 38 may be reversed, if desired, and the control valve operated appropriately to cause injection of fuel at appropriate points in the operating cycle of an associated engine. In this case, the control valve would normally be held open, conveniently by a spring, the actuator being used to close the control valve.

If desired, the control valve 42 and the fuel pressure actuable valve 14 may be incorporated within a fuel injector of which the injection nozzle 18 forms part. Alternatively, of course, one or more of the control valve 42 and the fluid pressure actuable valve 14 may be located externally of the fuel injector.

What is claimed is:

1. A fuel injector for use in a fuel system having a control fluid source and a high pressure fuel source, comprising;

(i) an injection nozzle;

(ii) a control valve comprising a control valve member moveable between first and second positions; and (iii) a fluid pressure actuable valve comprising a fluid pressure actuable valve member and a seating, said fluid pressure actuable valve member being moveable under control of said control fluid between an open position in which it is spaced from the seating and a closed position in which it is engaged with the seating;

wherein when said control valve member is in the first position, a control fluid flow path exists from the control fluid source to the fluid pressure actuable valve member;

wherein a fuel flow path exists from the high pressure fuel source to the injection nozzle through the fluid pressure actuable valve when said fluid pressure actuable valve member is in the open position, said fuel flow path passing between the fluid pressure actuable valve member and the seating, and wherein, in use, movement of the fluid pressure actuable valve member between the open and closed positions is by contact of the control fluid under pressure therewith.

2. A fuel injector as claimed in claim 1, wherein the fluid pressure actuable valve member is biased towards its closed position, control fluid under pressure acting to move the pressure actuable valve member towards its open position.

3. The fuel injector as claimed in claim 1, wherein said control valve is an electromagnetically controlled valve.

4. The fuel injector as claimed in claim 1, wherein said control valve is located between said fluid pressure actuable valve and a low pressure drain.

5. The fuel injector as claimed in claim 1, wherein said control valve is arranged to control fluid pressure within a control chamber defined, in part, by a surface associated with said fluid pressure actuable valve.

6. The fuel injector as claimed in claim 1, wherein said fluid pressure actuable valve includes an annular seal to restrict cross-contamination of pressurized fuel from said high pressure fuel source and control fluid from said control fluid source.

7. A fuel system for use in supplying pressurized fuel to a combustion space, said fuel system comprising:

(i) a fuel source of pressurized fuel;

(ii) a source of control fluid under pressure;

(ii) a low pressure fuel reservoir; and (iii) a fuel injector including an injection nozzle, a control valve capable of first and second positions, and a fluid pressure actuable valve being actuable under control of said control fluid between an open position and a closed position, wherein when said control valve is in the first position, a control fluid flow path exists from the control fluid source to the fluid pressure actuable valve, and wherein a fuel flow path exists from the high pressure fuel source to the injection nozzle through the fluid pressure actuable valve when said fluid pressure actuable valve is in the open position, and wherein, in use, movement of the fluid pressure actuable valve between the open and closed positions is by contact of the control fluid under pressure therewith.

8. The fuel system as claimed in claim 7, wherein said control valve is an electromagnetically controlled valve.

9. The fuel system as claimed in claim 7, wherein said control valve is located between said source of control fluid under pressure and said fluid pressure actuable valve.

10. The fuel system as claimed in claim 7, wherein said control valve is located between said fluid pressure actuable valve and a low-pressure drain.

11. The fuel system as claimed in claim 7, wherein said control valve is arranged to control fluid pressure within a control chamber defined, in part, by a surface associated with said fluid pressure actuable valve.

12. The fuel system as claimed in claim 7, wherein said restrict cross-contamination of pressurized fuel from said high pressure fuel source and control fluid from said source of control fluid.

13. The fuel system as claimed in claim 7, wherein said fuel source of pressurized fuel is a common rail.

14. A fuel system as claimed in claim 7, wherein said fluid pressure actuable valve is arranged to control communication between at least one passage of said injection nozzle and the low pressure fuel reservoir.

15. A fuel system as claimed in claim 7, wherein said fluid pressure actuable valve of said injector is arranged to control communication between at least one chamber of said injector nozzle and the low pressure fuel reservoir.

* * * * *